US007335237B2

(12) United States Patent
Watanabe

(10) Patent No.: US 7,335,237 B2
(45) Date of Patent: Feb. 26, 2008

(54) METHOD FOR TEXTILE PRINTING, PRE-TREATMENT FLUID FOR TEXTILE PRINTING AND FIBER SHEET FOR TEXTILE PRINTING

(75) Inventor: Kazue Watanabe, Tokyo (JP)

(73) Assignee: Denenchofu Roman Co., Ltd., Tokyo (JP)

( * ) Notice: Subject to any disclaimer, the term of this patent is extended or adjusted under 35 U.S.C. 154(b) by 329 days.

(21) Appl. No.: 10/499,670

(22) PCT Filed: Dec. 20, 2002

(86) PCT No.: PCT/JP02/13399

§ 371 (c)(1),
(2), (4) Date: Aug. 12, 2004

(87) PCT Pub. No.: WO03/054288

PCT Pub. Date: Jul. 3, 2003

(65) Prior Publication Data

US 2004/0263598 A1 Dec. 30, 2004

(30) Foreign Application Priority Data

Dec. 20, 2001 (JP) ..... 2001-388585

(51) Int. Cl.
*D06P 5/00* (2006.01)
*D06P 5/24* (2006.01)

(52) U.S. Cl. ..... 8/445; 8/467

(58) Field of Classification Search ..... 8/445, 8/467

See application file for complete search history.

(56) References Cited

U.S. PATENT DOCUMENTS

| | | | | |
|---|---|---|---|---|
| 5,635,297 | A * | 6/1997 | Ogawa et al. | 428/342 |
| 5,676,707 | A | 10/1997 | Kuwabara | |
| 5,677,067 | A * | 10/1997 | Kojima et al. | 428/32.27 |
| 5,824,462 | A * | 10/1998 | Ashida et al. | 430/531 |
| 6,022,383 | A | 2/2000 | Kuwabara | |
| 2002/0119296 | A1* | 8/2002 | Kasahara | 428/195 |

* cited by examiner

*Primary Examiner*—Lorna M. Douyon
*Assistant Examiner*—Amina Khan
(74) *Attorney, Agent, or Firm*—Jordan and Hamburg LLP

(57) ABSTRACT

A method for forming a desired textile printing pattern by allowing a fiber sheet to absorb a dye ink by the use of, for example, the ink-jet system, which comprises allowing a pre-treating fluid containing an aqueous emulsion having a solid component comprising an ethylene-vinyl acetate copolymer and a vinyl acetate-acrylic monomer copolymer and a fixing agent for the dye to soak into the fiber sheet, followed by drying, and then subjecting the resulting fiber sheet to a textile printing with the dye ink.

4 Claims, No Drawings

METHOD FOR TEXTILE PRINTING, PRE-TREATMENT FLUID FOR TEXTILE PRINTING AND FIBER SHEET FOR TEXTILE PRINTING

FIELD OF THE INVENTION

The present invention relates to a method for forming a desired textile printing pattern by allowing a fiber sheet to absorb a dye ink, a pre-treating fluid that can be used for the textile printing method, and a fiber sheet for textile printing.

BACKGROUND OF THE INVENTION

In recent years, performances of ink-jet color printers have been remarkably improved. In ink-jet printing on a paper, it is possible to obtain easily and quickly a color print having a quality as high as that of a photograph in particular by the use of a specialty paper having on the surface thereof an ink accepting layer containing a pigment. or a binder.

On the other hand, various trials have been made to apply the printing technique of an ink-jet system to a cloth. However, the conventional ink-jet system has the following problems.

That is, when the ink-jet system is applied to printing, either a pigment ink or a dye ink can be selectively used. In general, the dye ink is an aqueous ink and the viscosity thereof can be made low easily. Such dye ink is advantageous in that clogging on nozzle tips can be prevented easily. The dye ink is further advantageous in that a cloth can maintain the texture thereof even after printing is carried out thereon because the fiber of the cloth is directly dyed with the dye ink Accordingly, printing (textile printing) on a cloth is preferably carried out by the use of the ink-jet system and the dye ink. Printing on a Japanese paper is also preferably carried out in the same manner.

However, when the dye ink is used for a fiber sheet such as a cloth, a Japanese paper or the like, it is difficult to form a sharp textile printing pattern and a pre-treatment is therefore necessary for prevention of bleeding. As a matter of common knowledge of textile printing on a cloth, troublesome post-treatments including the steps of heating with hot steam, washing, drying and the like is required after a textile printing is carried out.

Accordingly, it is still difficult to easily and quickly obtain a cloth capable of being used for a sharp and high-quality ink-jet textile printing.

In addition, the term "Japanese paper" means a paper which has been manufactured in Japan from old times. The Japanese papers can be classified into two types: hand-made papers and machine-made papers. The former are made from a phleom fiber of trees such as paper mulberry, trident daphne. Shikoku daphne and the like, and further classified into a Japanese writing paper, a mino paper, a thick Japanese paper, a Japanese vellum and the like. The latter are made from a fiber of waste paper, wood pulp, rag, hemp of Manila, trident daphne and the like, and further classified into a bathroom tissue paper, a pocket tissue paper, a sliding screen paper, a calligraphic paper, a rough printing paper and the like.

Accordingly, it is an object of the present invention to provide a textile printing method which needs no troublesome post-processing including a number of steps, and is capable of obtaining easily a sharp print which is free from bleeding without ruining a texture of a fiber sheet. Another object of the present invention is to provide a pre-treating fluid which makes it possible of the above textile printing method. A further object of the present invention is to provide a fiber sheet for textile printing.

DISCLOSURE OF THE INVENTION

In order to achieve the above object, the present invention provides a textile printing method comprising the steps of: allowing an aqueous emulsion having a solid component comprising a non-viscous resin and a pre-treating fluid containing a fixing agent for a dye to soak into a fiber sheet; drying the fiber sheet soaked with the pre-treating fluid to cross-link the copolymers of the solid component; and allowing the dried fiber sheet having thereon the cross-linked copolymers of the solid component to absorb a dye.

In the above textile printing method, the fixing agent for a dye can be selected optionally in accordance with a type of a dye used. When the fiber sheet soaked with the pre-treating fluid comprising the aqueous resin emulsion having the solid compound comprising an ethylene-vinyl acetate copolymer and a vinyl acetate-acrylic monomer copolymer is dried, the ethylene-vinyl acetate copolymer and the vinyl acetate-acrylic monomer copolymer composing the solid component of the aqueous emulsion, are cross-linked and bound to the fiber of the fiber sheet in such a manner that the copolymers wrap the fiber of the fiber sheet. The fixing agent for a dye is uniformly distributed and bound to the cross-linked copolymers of the solid component of the aqueous emulsion wrapping the fiber.

When a textile printing on the dried fiber sheet is carried out using a dye ink in the above state, the dye ink is effectively guided to the fiber by the dried cross-linked body comprising the ethylene-vinyl acetate copolymer and the vinyl acetate-acrylic monomer copolymer wrapping the fiber. By the synergy effect of the cross-linked body and the fixing agent for a dye, the dye ink is prevented from bleeding on a print whereas the fiber of the fiber sheet is allowed to absorb a dye surely. Thus, the color is fixed on the print.

The cross-linked body formed by drying the solid component comprising the ethylene-vinyl acetate copolymer and vinyl acetate-acrylic monomer copolymer of the aqueous resin emulsion is neither cured nor adhesive. Accordingly, even when dried fiber sheets are laminated, the fiber sheets do not adhere to each other. When the fiber sheets are subjected to a dyeing step in a printer for textile printing, the fiber sheets do not adhere to the printer. Further, the dyed and dried fiber sheets do not adhere to each other.

Sharp and high-quality dyeing is completed when the fiber is thus dyed. Accordingly, troublesome post-treatments including the steps of fixing a color after dyeing, heating with hot steam, washing and the like can be omitted.

Further, even when the fiber sheet thus dyed is washed, it is possible to keep a sharp and high-quality textile printing pattern free from color fading. The cross-linked body comprising the ethylene-vinyl acetate copolymer and the vinyl acetate-acrylic monomer copolymer having been dried and bonded to the fiber can keep being bonded to the fiber even after being washed with water. The cross-linked body is further advantageous in that the surface of the fiber sheet exhibits a silk-like gloss by the virtue of the transparent coating formed on the surface of the fiber and the textile pattern thereon when the fiber sheet is dried after being subjected to a textile printing.

A textile printing using an ink-jet system is preferably applied to the dyeing step according to the present invention. However, other dyeing methods including, for example, a screen printing system, a pattern dyeing, a hand-writing dyeing and the like may also be applied.

The aqueous resin emulsion having the solid component comprising the ethylene-vinyl acetate copolymer and the vinyl acetate-acrylic monomer copolymer is preferably diluted with water so that the weight ratio of water and the solid component (copolymers) is in the range from 10:1 to 50:1 in use. Due to the characteristics of the ethylene-vinyl acetate copolymer and the vinyl acetate-acrylic monomer copolymer, the texture of the cloth is not ruined even when the fiber is coated on the surface thereof with the cross-linked substances in such a manner that the cross-linked substances are bonded to the fiber of the fiber sheet.

According to the aforementioned textile printing method, a sharp print which is free from bleeding can be obtained easily without ruining the texture of the fiber sheet and without necessity of the troublesome post-treatments including a number of steps.

The textile printing method according to the present invention may further comprise a step of detachably applying an exfoliation sheet produced by forming a coating of the aqueous resin emulsion having a solid component comprising the acrylic monomer-vinyl acetate copolymer on one surface of the dried fiber sheet on which the copolymers of the aforementioned solid component are cross-linked, the step being inserted between the drying step and the dyeing step. The application of the exfoliation sheet onto the fiber sheet is effective in particular when the fiber sheet is a thin and soft cloth.

Different from the ethylene-vinyl acetate copolymer and the vinyl acetate-acrylic monomer copolymer, the aqueous resin emulsion having the solid component comprising the acrylic monomer-vinyl acetate copolymer maintains an appropriate adhesion in a dry state. This feature of the aqueous resin emulsion can be used to apply the exfoliation sheet onto the fiber sheet.

The above application step allows a fiber sheet without a tense to have a tense via the exfoliation sheet by reinforcing the rear surface of the fiber sheet with the exfoliation sheet. Accordingly, a fiber sheet cut into a specific size can be subjected easily to a textile printing.

When the above exfoliation sheet is used, the fiber sheet having been dried after being soaked with the pre-treating fluid can be applied onto the surface of the film after the coating of the aqueous resin emulsion having the solid component comprising the acrylic monomer-vinyl acetate copolymer is dried. In this case, when the exfoliation sheet is peeled off the fiber sheet having been subjected to a textile printing, the dried coating of the acrylic monomer-vinyl acetate copolymer is separated from the fiber sheet with the exfoliation sheet because the coating adheres to the exfoliation sheet. Thus, a textile print without an adhesion remaining on the rear surface of the fiber sheet can be obtained.

On the other hand, the fiber sheet having been dried after being soaked with the pre-treating fluid can be applied onto the surface of the film before the coating of the aqueous resin emulsion having the solid component comprising the acrylic monomer-vinyl acetate copolymer is dried. In this case, when the exfoliation sheet is peeled off the fiber sheet having been subjected to an ink-jet textile printing, the dried coating of the acrylic monomer-vinyl acetate copolymer in a form of a film adhering to the fiber sheet is separated from the exfoliation sheet with the fiber sheet because the dried coating of the acrylic monomer-vinyl acetate copolymer is bonded strongly to the ethylene-vinyl acetate copolymer and the vinyl acetate-acrylic monomer copolymer. Thus, a textile print having on the rear surface thereof an adhesion can be obtained.

The present invention further provides a pre-treating fluid for a textile printing containing an aqueous emulsion having a solid component comprising an ethylene-vinyl acetate copolymer and a vinyl acetate-acrylic monomer copolymer and a fixing agent for a dye.

The use of the pre-treating fluid having the above structure makes it possible to realize easily a textile printing on a cloth and a Japanese paper. This pre-treating fluid for a textile printing can be allowed to soak into a paper at the time of manufacturing. Accordingly, when a paper treated by the pre-treating fluid for a textile printing is used, it is possible to carry out a high-quality textile printing (e.g., an ink-jet textile printing) free from bleeding on the surface of the paper without an ink accepting layer. When a cloth woven with threads treated by the pre-treating fluid for a textile printing at the time of spinning is used, it is possible to carry out a high-quality textile printing (e.g., an ink-jet textile printing) free from bleeding.

The present invention furthermore provides a fiber sheet for a textile printing produced by allowing a pre-treating fluid containing an aqueous resin emulsion having a solid component comprising an ethylene-vinyl acetate copolymer and a vinyl acetate-acrylic monomer copolymer and a fixing agent for a dye to soak into a fiber, followed by drying.

The use of the fiber sheet for a textile printing having the above structure makes it possible to easily realize the aforementioned textile printing method.

BEST MODE FOR CARRYING OUT THE INVENTION

The preferred embodiments of the present invention will be described in detail hereunder.

A fiber structure used in the present invention, i.e., a fiber sheet is made from various materials. Examples of such materials include: natural fibers such as cotton, rayon, hemp, silk and wool; semi-synthetic resins such as acetate and triacetate; synthetic resins such as polyester, nylon and acrylic resin; cloths produced by mixed spinning, combined weaving and the like; and a Japanese paper capable of keeping a form of a sheet even in a wet state. Preferable examples of cloths include a woven cloth, a knitted cloth, an nonwoven cloth and the like.

Preferable examples of dyes used in the present invention include a direct dye, a reaction dye, an acid dye, a cationic dye, a dispersion dye and the like. Each dye can be used optionally in accordance with a fiber material of a fiber sheet used. For example, the direct dye, the acid dye and the reaction dye can be used for a silk fiber, the direct dye and the reaction dye for a cotton fiber, the dispersion dye for a polyester fiber, and the acid dye and the reaction dye for a nylon fiber.

A medium used for a conventional general textile printing or a medium for a conventional ink-jet system can be used as a medium for dissolving or dispersing the above dyes in the present invention. Examples of such media include water and a mixture of water and an organic solvent. In general, water is used as the medium. A dye ink can be necessarily added with various dispersants, surfactants, viscosity adjusters, surface tension adjusters, pH adjusters, conductivity adjusters and the like.

When a color image is printed, at least four color inks of yellow, cyan, magenta and black are preferably prepared.

When the textile printing method according to the present invention is carried out, first a pre-treating fluid containing an aqueous resin emulsion having a solid component comprising an ethylene-vinyl acetate copolymer and a vinyl-acrylic monomer copolymer and a fixing agent for a dye is allowed to soak into a fiber sheet, the fixing agent for a dye being selected in accordance with a type of a dye ink used.

The aqueous resin emulsion having the solid component comprising the ethylene-vinyl acetate copolymer and the vinyl-acrylic monomer copolymer is preferably diluted with water so that the weight ratio of water and the solid component is in the range from 6:4 to 4:6. Further, the aqueous resin emulsion can be produced more effectively by using 50% by weight of water and the solid component, respectively. The aqueous resin emulsion may contain a small amount (3% to 5% by weight) of toluene as an additive. However, the addition of such additive may be omitted.

The fixing agent for a dye can be appropriately selected in accordance with a type of a dye ink used. For example, a fixing agent of a dicyanamide or a polyethylene polyamine can be used for the direct dye ink, and a fixing agent of a polyethylene polyamine or polycation for the reaction dye ink. Further, a fixing agent of a tannin can be used for the acid dye ink and a substance in which fine particles of an ultraviolet ray absorbing agent of a benzotriazole are dispersed can be used for the dispersion dye ink. Commercially available fixing agents for a dye can be used to fix the above dyes. For example, DANFIX-723 (tradename, manufactured by Nitto Boseki Co., Ltd.) and Micanol (tradename, manufactured by Katsuraya Fine Goods KK) are preferably used, and Color Stop (tradename, manufactured by Dylon Corporation) and Simplicol (tradename, manufactured by Fujikyu Corporation.) may also be used to fix the direct dye ink and the reaction dye ink.

When the pre-treating fluid is prepared using the aqueous emulsion and the fixing agent for a dye, the mixture of the aqueous emulsion and the fixing agent for a dye may be diluted with water, or the fixing agent for a dye may be mixed with the aqueous emulsion diluted with water.

When the aqueous resin emulsion having the solid compound comprising the ethylene-vinyl acetate copolymer and the vinyl acetate-acrylic monomer copolymer is mixed with the fixing agent for a dye and then the mixture is diluted with water, a mixing ratio of the aqueous resin emulsion and the fixing agent for a dye may be selected optionally. However, when DANFIX-723 (tradename, manufactured by Nitto Boseki Co., Ltd). is used as a fixing agent for a dye, the aqueous resin emulsion and the fixing agent for a dye are preferably mixed in the weight ratio of 1:1. Thereafter, the mixture of the aqueous resin emulsion and the fixing agent for a dye is preferably diluted for 20 times with water.

On the other hand, when the aqueous resin emulsion having the solid compound comprising the ethylene-vinyl acetate copolymer and the vinyl acetate-acrylic monomer copolymer is diluted with water and then mixed with the fixing agent for a dye, the weight ratio of water and the solid component (copolymers) is preferably in the range of 10:1 to 50:1. If the weight ratio of water to the solid component (copolymers) is less than 10 times, the viscosity of the aqueous resin emulsion is too high to soak thoroughly into the fiber sheet. If the weight ratio of water to the solid component (copolymers) is more than 50 times, the cloth having been dried after being soaked with the aqueous resin emulsion is incompletely coated with the film comprising the cross-linked ethylene-vinyl acetate copolymer and vinyl acetate-acrylic monomer copolymer resulting in insufficient prevention of bleeding on the uncoated part.

Further, when Micanol (tradename, manufactured by Katsuraya Fine Goods KK) is used as a fixing agent for a dye, about 2 cc of Micanol is preferably added to 1000 cc of aqueous resin emulsion diluted with water. Addition of either more or less than 2 cc of Micanol to the aqueous resin emulsion decreases the effect of color fixation.

The fiber sheet soaked with the pre-treating fluid is dried to obtain the fiber sheet for textile printing.

Subsequently, a dye is applied onto the fiber sheet for textile printing by, for example, an ink-jet system.

Preferred examples of ink-jet systems usable herein include: a bubble-jet system, wherein a heat generating resistive element is embedded in a nozzle, an ink is boiled by the heat generated from the heat generating resistive element, and the ink is jetted by the pressure of the bubbles formed in the boiled ink; a pulse-jet system, wherein a piezoelectric device is deformed by being applied with an electric signal to excite a change in the volume of an ink chamber to jet particles of an ink; and a charge control system, wherein an ink is continuously jetted by a pressure from a nozzle vibrated by a supersonic wave to change the ink into particles, and the particles are passed and deflected in a constant electric field of which an amount of charge is controlled and divided into recording and non-recording particles to carry out recording.

In general, since the aforementioned fiber sheet for textile printing does not have a tension, an ink-jet textile printing is preferably carried out in such a manner that a roll of the fiber sheet for textile printing is rolled out and then rolled into another roll so that a tension is given to the fiber sheet between the two rolls.

When a textile printing is carried out on the above fiber sheet for a textile printing, bleeding is prevented whereas a color is fixed using the fixing agent for a dye. Accordingly, it is possible to omit post-treatments including the steps of fixing a color by using a fixing solution, heating with steam, washing and the like after the textile printing is carried out.

Further, even when the cloth having been subjected to the above textile printing is washed with water, color fading is not caused and the cloth can keep a sharp and high-quality textile printing pattern thereon. The mixture of the ethylene-vinyl acetate copolymer and the vinyl acetate-acrylic monomer copolymer having been dried to cross-link the copolymers and bonded to the fiber maintains a bonded state to the fiber even after the fiber sheet is washed with water. When the fiber sheet is dried, a transparent coating is formed on the fiber and the textile printing pattern thereon so as to exhibit a silk-like gloss on the surface of the fiber sheet.

Still further, even when the fiber of the fiber sheet is coated on the surface thereof with the cross-linked ethylene-vinyl acetate copolymer and vinyl acetate-acrylic monomer copolymer bonded to the fiber, the texture of the fiber sheet is not ruined due to the characters of the copolymers.

Accordingly, the above textile printing method makes it possible to obtain a sharp textile print free from bleeding without necessity of troublesome post-treatments including a number of steps and without ruining the texture of the fiber sheet.

In addition, even when the cloth having been subjected to a textile printing by the above method is wetted or washed with water, a dye is not washed out of the cloth. However, when it is necessary to fix the dye further firmly, the fiber sheet having been subjected to a textile printing can be heated at a temperature of 160 to 180° C. In each home, the fiber sheet is preferably ironed to fix the dye firmly. In this heating process, the cross-linked ethylene-vinyl acetate copolymer and vinyl acetate-acrylic monomer copolymer are metamorphosed into a further stable resin film resulting in improvement of waterfastness.

On the other hand, when a textile printing is carried out on a fiber sheet cut into a predetermined size, the coating of the aqueous resin emulsion having a solid component comprising an acrylic monomer-vinyl acetate copolymer is preferably formed on the exfoliation sheet, and the textile printing is preferably carried out in a state where the exfoliation sheet is applied onto one side of the fiber sheet for a dye, i.e., the fiber sheet which has been dried after being soaked with the aforementioned pre-treating fluid. An exfoliation paper, a cellophane film or the like can be used as an exfoliation sheet.

The aqueous resin emulsion having the solid component comprising the acrylic monomer-vinyl acetate copolymer is different from the ethylene-vinyl acetate copolymer or the vinyl acetate-acrylic monomer copolymer in that an appropriate adhesion can be maintained in a dry state. Accordingly, by the virtue of such structure, the fiber sheet without a tension can be reinforced by applying on the rear surface thereof an exfoliation sheet so as to give a tension to the fiber sheet via the exfoliation sheet. Thus, a textile printing can be carried out easily even on a fiber sheet cut into a specific size.

When the above exfoliation sheet is used, the fiber sheet having been soaked with the pre-treating fluid and dried after the coating of the aqueous resin emulsion having the solid component comprising the acrylic monomer-vinyl acetate copolymer is dried can be applied onto the surface of the aforementioned film. In this case, when the exfoliation sheet is peeled off the fiber sheet having been subjected to a textile printing, the dried coating of the acrylic monomer-vinyl acetate copolymer adheres to the exfoliation sheet and separated easily from the fiber sheet. Thus, a textile print without an adhesion remaining on the rear surface of the fiber sheet can be obtained.

Further, when the fiber sheet is wetted with water before being peeled off the exfoliation sheet, the dried film of the acrylic monomer-vinyl acetate copolymer can be separated further effectively from the fiber sheet.

On the other hand, the fiber sheet having been soaked with the pre-treating fluid and dried before the coating of the aqueous resin emulsion having the solid component comprising the acrylic monomer-vinyl acetate copolymer is dried can be applied onto the surface of the aforementioned film. In this case, when the exfoliation sheet is peeled off the fiber sheet having been subjected to a textile printing, the coating of the acrylic monomer-vinyl acetate copolymer is bonded strongly to the cross-linked body comprising the ethylene-vinyl acetate copolymer and the vinyl acetate-acrylic monomer copolymer so that the coating in a form of a film adheres to the fiber sheet and is not separated from the exfoliation sheet. Thus, a textile print having on the rear surface thereof an adhesion can be obtained.

PREFERRED EMBODIMENTS OF THE PRESENT INVENTION

Next, the present invention will be described with reference to the examples.

EXAMPLE 1

In this example, a flat-woven cotton cloth destarched and bleached by a normal method was used as a cloth (fiber sheet).

On the other hand, an aqueous resin emulsion having a solid component comprising an ethylene-vinyl acetate copolymer and a vinyl acetate-acrylic monomer copolymer (solid component: 50% by weight, toluene: 4% by weight, water: 46% by weight) is diluted with water in a weight ratio of 5:100. Further, 2 cc of Micalon was added to 1000 cc of the aqueous resin emulsion to prepare a pre-treating fluid for a dye.

The above cloth was dried after being dipped into and soaked with the pre-treating fluid to provide a cloth for a textile printing.

PM2200 manufactured by Epson Corporation was used as an ink-jet printer and a dye ink (manufactured by Epson Corporation) for this printer was used to carry out an ink-jet textile printing on the above cloth for a textile printing.

EXAMPLE 2

A cloth for a textile printing was produced in the same manner as in Example 1. On the other hand, an aqueous resin emulsion having a solid component comprising an acrylic monomer-vinyl acetate copolymer (solid component: 50% by weight, water: 50% by weight) was further diluted appropriately with water and the diluted aqueous resin emulsion was coated onto an exfoliation paper to form a coating. After the coating was dried, the cloth for a textile printing was applied onto the surface of the coating to form a two-layer sheet comprising the exfoliation paper and the cloth.

An ink-jet textile printing was carried out using the ink-jet printer on the cloth side of the two-layer sheet.

EXAMPLE 3

A cloth for a textile printing was produced in the same manner as in Example 1. On the other hand, an aqueous resin emulsion having a solid component comprising an acrylic monomer-vinyl acetate copolymer (solid component: 50% by weight, water: 50% by weight) was further diluted appropriately with water and the diluted aqueous resin emulsion was coated on an exfoliation paper to form a coating. Before the coating was dried, the cloth for a textile printing was applied onto the surface of the coating to form a two-layer sheet comprising the exfoliation paper and the cloth.

An ink-jet textile printing was carried out using the ink-jet printer on the cloth side of the two-layer sheet.

COMPARATIVE EXAMPLE 1

An aqueous resin emulsion having a solid component comprising an ethylene-vinyl acetate copolymer and a vinyl acetate-acrylic monomer copolymer (solid component: 50% by weight, toluene: 4% by weight, water: 46% by weight) was diluted with water in a weight ratio of 5:100 (a fixing agent was omitted). A cloth was dried after being soaked with the diluted aqueous resin emulsion to provide a cloth for a textile printing.

An ink-jet printing was carried out using the above ink-jet printer on the cloth for a textile printing.

COMPARATIVE EXAMPLE 2

An aqueous resin emulsion having a solid component comprising an acrylic monomer-vinyl acetate copolymer (solid component: 50% by weight, water: 50% by weight) was further diluted appropriately with water and the diluted aqueous resin emulsion was applied onto an exfoliation paper to form a coating. Before the coating was dried, a cloth not soaked with the pre-treating fluid was applied onto the surface of the coating to form a two-layer sheet comprising the exfoliation paper and the cloth. Thereafter, the same pre-treating fluid as that described in Example 1 was sprayed onto the cloth side of the two-layer sheet to allow the pre-treating fluid to soak into the cloth to provide a cloth for a textile printing.

An ink-jet textile printing was carried out using the above ink-jet printer on the cloth for a textile printing.

COMPARATIVE EXAMPLE 3

An aqueous resin emulsion having a solid component comprising an ethylene-vinyl acetate copolymer and a vinyl acetate-acrylic monomer copolymer was omitted and only Micanol was allowed to soak into a cloth followed by drying to provide a cloth for a textile printing.

An ink-jet printing was carried out using the above ink-jet printer on the cloth for a textile printing.

Next, bleedings, dyeing properties and print qualities of the products obtained in Examples 1, 2, and 3 and Comparative Examples 1, 2, and 3 were evaluated into three levels (o, x, and Δ). The evaluation results are as shown in Table 1.

TABLE 1

| | Example 1 | Example 2 | Example 3 | Comparative Example 1 | Comparative Example 2 | Comparative Example 3 |
|---|---|---|---|---|---|---|
| Bleeding | o | o | o | Δ | o | x |
| Dyeing property | o | o | o | x | Δ | x |
| Quality | o | o | o | Δ - x | o | x |

As is clear from Table 1, the products obtained in Examples 1, 2, and 3 were free from bleeding, textile printing patterns thereon had sharp outlines, and the products obtained were high-quality cloths for a textile printing having thereon a silk-like gloss. Further, the products had fine textures, and no color fading or bleeding was caused even after the cloths were washed with water.

On the other hand, a slight bleeding was caused on the textile printing pattern formed on the product in Comparative Example 1. When the cloth was washed with water after being subjected to a textile printing, a bleeding was caused in a wide range.

The product in Comparative Example 2 showed substantially the equal bleeding and quality as those in Examples 1 to 3 after a textile printing was carried out. However, a phenomenon in which the color is slightly washed out was observed when the cloth was washed with water after being subjected to a textile printing.

Further, it was possible to allow the product in Comparative Example 3 to absorb a dye yet the dyed product showed a remarkable bleeding. When the dyed product was washed with water, the dye was washed out resulting in fading or removal of the color.

INDUSTRIAL APPLICABILITY

As is clear from the above description, according to the present invention, a sharp textile printing pattern free from bleeding can be printed easily on a fiber sheet including a cloth, a Japanese paper and the like without necessity of troublesome post-treatment including a number of steps and without ruining the texture of the fiber sheet.

A textile printing can be carried out easily on a two-layer sheet formed by applying an exfoliation sheet onto the fiber sheet having been dried after being soaked with a pre-treating fluid by the use of a commercially available inexpensive ink-jet printer. Accordingly, a sharp and high-quality ink-jet textile print can also be produced easily with a low cost in each home.

Further, the pre-treating fluid according to the present invention makes it possible to subject a plain paper and a thread, in addition to a cloth, to a pre-treatment for a textile printing.

What is claimed is:

1. A method for textile printing comprising the steps of:

soaking a pre-treating fluid containing an aqueous resin emulsion having a solid component comprising an ethylene-vinyl acetate copolymer, a vinyl acetate-acrylic monomer copolymer and a fixing agent for a dye into a fiber sheet;

drying said fiber sheet soaked with said pre-treating fluid to cross-link said copolymers composing said solid component;

allowing said fiber sheer having been dried to cross-link said copolymers to absorb a dye; and detachably applying an exfoliation sheet produced by forming a coating of an aqueous resin emulsion having a solid component comprising an acrylic monomer-vinyl acetate copolymer on one surface of said dried fiber sheet on which said copolymers of said solid component are cross-linked, said application step being inserted between said drying step and said dyeing step.

2. A method for textile printing according to claim 1, wherein said exfoliation sheet is applied onto said fiber sheet after the coating on said exfoliation sheet is dried.

3. A method for textile printing according to claim 1, wherein said exfoliation sheet is applied onto said fiber sheet before the coating on said exfoliation sheet is dried.

4. The method of claim 2 wherein said fiber sheet is a cloth.

* * * * *